US007334590B2

(12) United States Patent
Chang

(10) Patent No.: US 7,334,590 B2
(45) Date of Patent: Feb. 26, 2008

(54) ANTI-SLIP OPENING AND CLOSING DEVICE FOR SUN UMBRELLA

(76) Inventor: Wei-Chen Chang, No. 30, Ko Wha Street, Chiayi City 600 (TW)

( * ) Notice: Subject to any disclaimer, the term of this patent is extended or adjusted under 35 U.S.C. 154(b) by 89 days.

(21) Appl. No.: 11/306,953

(22) Filed: Jan. 17, 2006

(65) Prior Publication Data

US 2007/0163632 A1 Jul. 19, 2007

(51) Int. Cl.
*A45B 25/14* (2006.01)

(52) U.S. Cl. ..... 135/20.3; 135/98; 135/21; 242/396.5

(58) Field of Classification Search ..... 135/21, 135/28, 98, 20.3; 242/395, 396.6
See application file for complete search history.

(56) References Cited

U.S. PATENT DOCUMENTS

| | | | | |
|---|---|---|---|---|
| 2,595,697 | A | 5/1952 | Pereira | |
| 4,386,621 | A | 6/1983 | Redl | 135/20 M |
| 4,622,987 | A * | 11/1986 | Redl et al. | 135/20.3 |
| 5,711,333 | A * | 1/1998 | Vanderminden, Sr. | 135/20.3 |
| 6,170,497 | B1 * | 1/2001 | Ma | 135/20.3 |
| 6,182,917 | B1 * | 2/2001 | Lai | 242/390.8 |
| 6,230,724 | B1 * | 5/2001 | Lai | 135/20.3 |
| 6,435,444 | B1 * | 8/2002 | Lin | 242/396.6 |
| 6,616,129 | B1 * | 9/2003 | Lee | 254/266 |
| 6,722,381 | B2 | 4/2004 | Lai | 135/20.3 |
| 6,732,753 | B2 | 5/2004 | Chang | 135/20.3 |
| 6,871,659 | B2 * | 3/2005 | Tung | 135/20.3 |
| 6,953,043 | B2 * | 10/2005 | Yu | 135/20.1 |
| 7,134,442 | B2 * | 11/2006 | Ma | 135/20.1 |
| 2002/0079398 | A1 * | 6/2002 | Liu | 242/395 |

FOREIGN PATENT DOCUMENTS

WO WO 2004014175 A1 * 2/2004

* cited by examiner

*Primary Examiner*—Winnie Yip
(74) *Attorney, Agent, or Firm*—Alan Kamrath; Kamrath & Associates PA

(57) ABSTRACT

An anti-slip opening and closing device for an umbrella is described, which comprises a rope reeled on a roller positioned on a pole of the umbrella. The roller is screwed with a reel having a friction disc. The friction disc is set inside a notch of a ratchet wheel. An elastic accessory is positioned between the roller and the ratchet wheel for pushing the friction disc to lean against the ratchet wheel. A block part is disposed to resist the ratchet wheel reversing. A bearing positioned at a side of the reel leans against beads of a cap positioned on the pole. When the reel is rotated clockwise, the roller and the reel are screwed together, and the rope is reeled by the roller. Hence, the umbrella is opened due to the pull of the rope, and the roller is not reversed by the obstruction of the block part. On the other hand, the reel is backed from the roller by rotating counterclockwise and leans against the beads. The friction between the friction disc and the ratchet wheel becomes minor if the reel keeps rotating. Then, the rope is released and the umbrella is folded gradually. If the reel stops rotating, the roller also stops rotating because of the friction produced between the friction disc and the ratchet wheel. Therefore, it is easy to operate the umbrella and to prevent the umbrella collapsing suddenly.

1 Claim, 8 Drawing Sheets

ANTI-SLIP OPENING AND CLOSING DEVICE FOR SUN UMBRELLA

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Field of the Invention

The present invention relates to an anti-slip opening and closing device for a sun umbrella, which has the function of anti-slipping and also provides a simple operating manner. That is, the umbrella is opened or closed merely by rotating a handle thereof.

2. Background of the Invention

Conventionally, the sunshade umbrella is opened and closed by means of the control device of the pole, which has been described in U.S. patents like U.S. Pat. No. 2,595,697, U.S. Pat. No. 4,386,621, U.S. Pat. No. 5,711,333, U.S. Pat. No. 6,722,381, and U.S. Pat. No. 6,732,753. These patents of U.S. Pat. No. 2,595,697, U.S. Pat. No. 4,386,621 and U.S. Pat. No. 5,711,333 disclose that a tape is rolled or released by rotating a reel with a handle, and the rib structure is expanded and fixed by means of a ratchet wheel and a pawl. Otherwise, the rib structure is folded by releasing the tape through the handle when the pawl is withdrawn from the ratchet wheel.

Such manner can prevent the opened umbrella from collapsing suddenly. However, the user must hold the handle and release the tape slowly to close the umbrella because the weight of rib structure results in the reversion of the ratchet wheel. If the hand of the user slips off the handle, the umbrella may collapse suddenly.

The patents of U.S. Pat. No. 6,722,381 and U.S. Pat. No. 6,732,753 disclose similar ways to control the umbrella. Still, there is concern about the sudden collapse of the umbrella.

SUMMARY OF THE INVENTION

Accordingly, an embodiment of the invention comprises a rope reeled on a roller positioned on a pole of the umbrella. The roller is screwed with a reel having a handle. A friction disc is set inside a notch of a ratchet wheel near the reel. The ratchet wheel is obstructed by an extended block part. An elastic accessory is positioned between the roller and the ratchet wheel for pushing the friction disc to lean against the ratchet wheel. A bearing positioned at a side of the reel leans against beads of a cap positioned on the reel. As a result, the rope is rolled or released by rotating the roller clockwise or counterclockwise with the handle.

When the reel is rotated clockwise, the roller and the reel are screwed together, and the rope is reeled by the roller. Hence, the umbrella is opened due to the pull of the rope, and the roller is not reversed by the obstruction of the block part.

On the other hand, when the reel is backed from the roller by rotating counterclockwise, the elastic accessory keeps pushing the ratchet wheel, in order to induce friction between the ratchet wheel and the friction disc. Consequently, the rope is released only when the handle is rotated. If the handle stops rotating, the roller also stops rotating because of the friction produced between the friction disc and the ratchet wheel. The problem of sudden collapse of the umbrella is thus solved.

As described above, the umbrella is opened or closed merely by rotating the handle clockwise or counterclockwise. It is not essential to operate the clutch as described in prior arts for preventing the umbrella from collapsing suddenly.

BRIEF DESCRIPTION OF THE DRAWINGS

The foregoing aspects, as well as many of the attendant advantages and features of this invention will become more apparent by reference to the following detailed description, when taken in conjunction with the accompanying drawings, wherein.

DETAILED DESCRIPTION OF PREFERRED EMBODIMENTS

Figure 1:
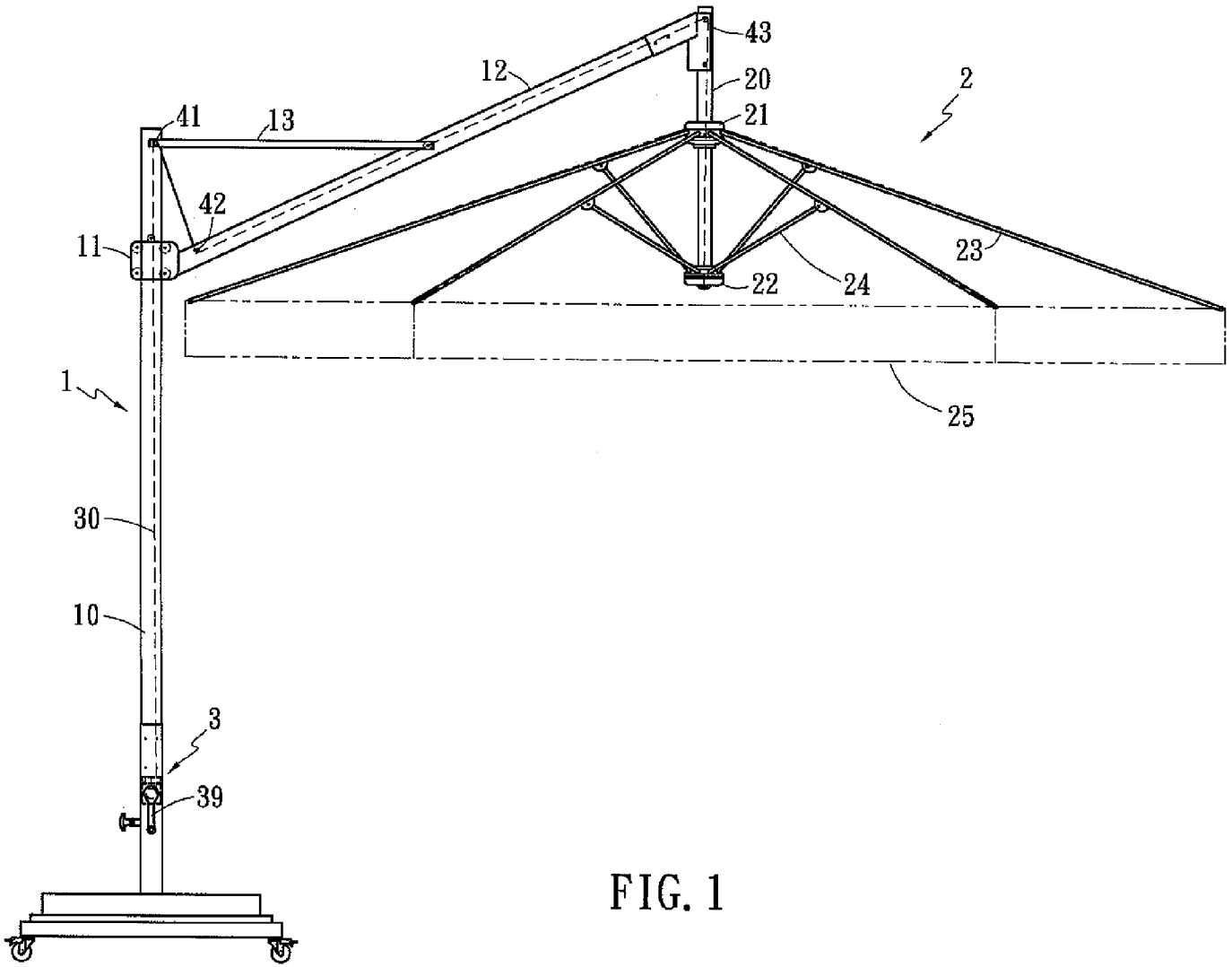
FIG. 1 illustrates the structure of an opened umbrella according to an embodiment of the invention.
Figure 2:
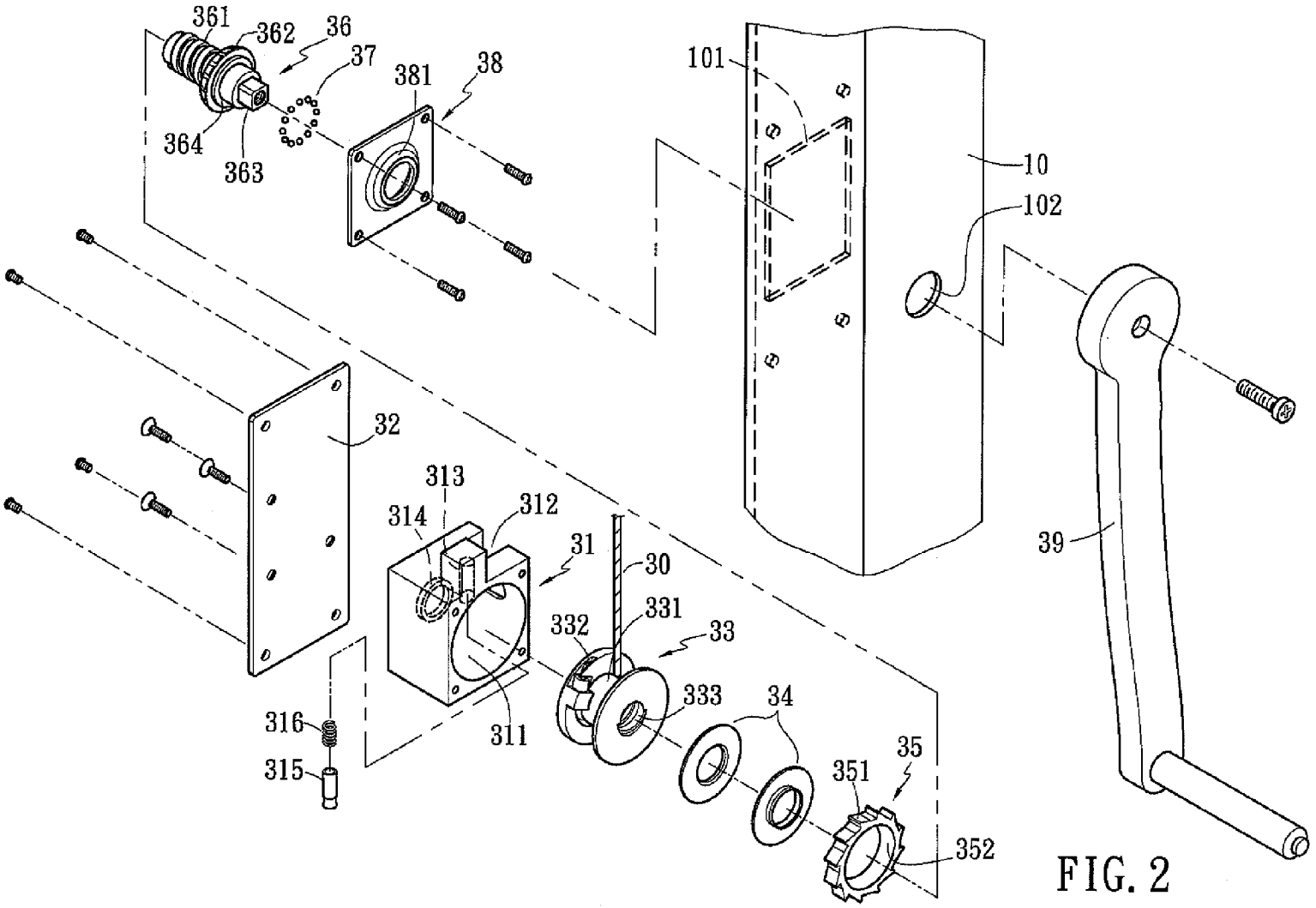
FIG. 2 illustrates an explored diagram of an anti-slip opening and closing device according to an embodiment of the invention.
Figure 3:
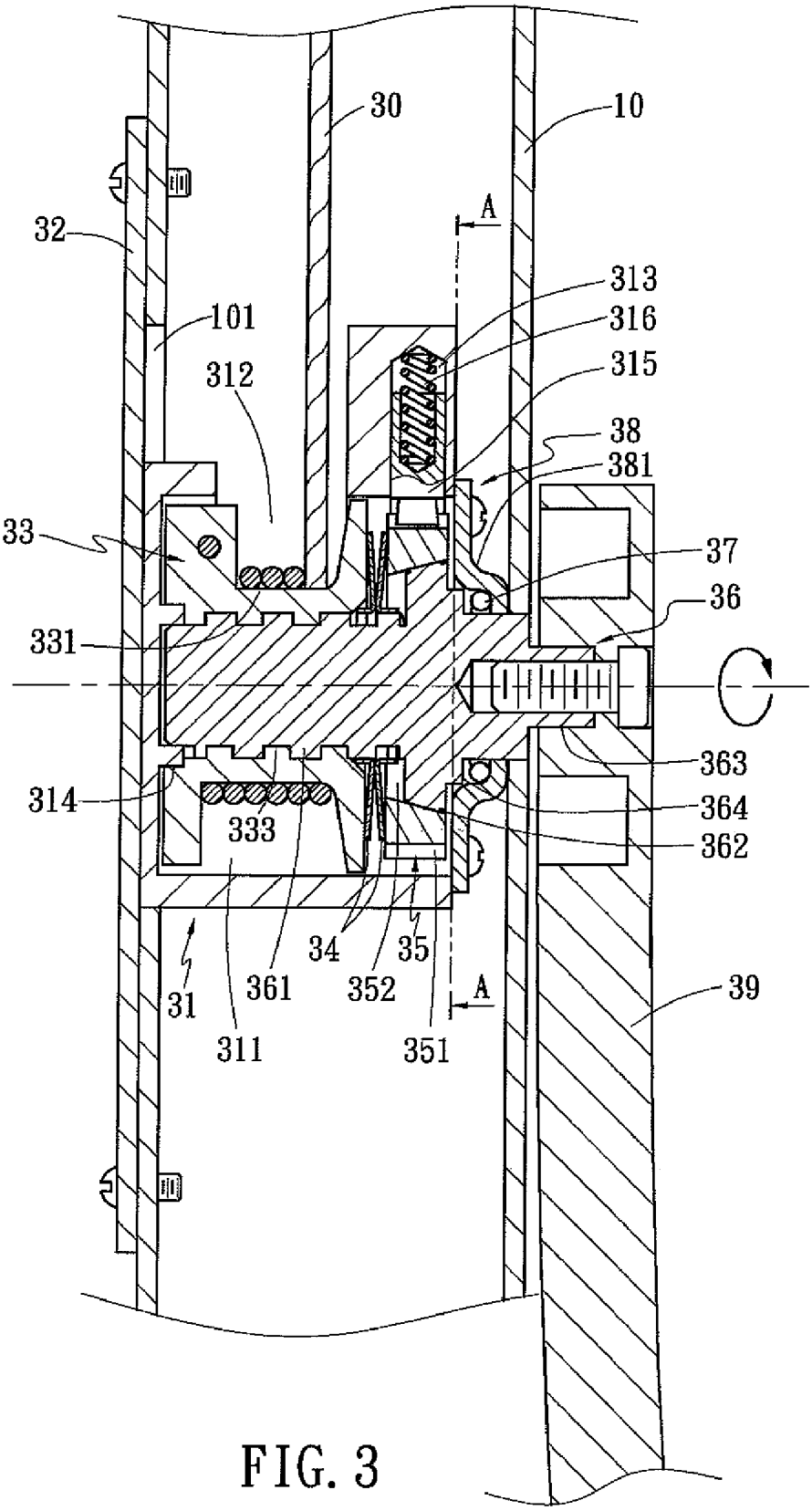
FIG. 3 illustrates the cross section of an anti-slip opening and closing device according to an embodiment of the invention.

Referring to FIGS. 1-3, the structure of an umbrella in accordance with one embodiment of the invention comprises a standing support member 1, an umbrella frame 2 pivotally suspended from the upper portion of the support member 1, and an anti-slip opening and closing device 3 disposed on the support member 1 for controlling the umbrella frame 2.

The support member 1 includes a pole 10 standing on the ground, a slide 11 upward and downward sliding along the pole 10, a boom 12 connected to the slide 11, and a connecting link 13 with one end pivotally connected to the upper end of the pole 10 and the other end connected to the middle of the boom 12. Another end of the boom 12 is connected to the umbrella frame 2.

The umbrella frame 2 includes a shaft 20 with an upper end connected to the terminal of the boom 12, an upper hub 21 fastened in the middle of the shaft 20, a plurality of ribs 23 connected to the upper hub 21 and covered by cloth 25, and a lower hub 22 with struts 24 positioned around itself and suspended by a rope 30. Each strut 24 is connected to the corresponding rib 23. As the lower hub 22 is moved upwards or downwards by pulling or releasing the rope 30, the ribs 23 are spread or collapsed by means of the struts 24. The lower hub 22 is fixed when upwardly shifted to the end of the shaft 20.

The anti-slip opening and closing device 3 includes a wheel base 31 having space 311 therein for a roller 33. A flange 314 is bulged on the bottom of the space 311, and an opening 312 is deployed on the wheel base 31. The inner side of the roller 33 is pivotally disposed on the flange 314. One end of the rope 30 is infixed in the groove 332 of the roller 33 for reeling the same around the spool 331 of the roller 33. Further, the screw 361 of a reel 36 screws in a hole 333 positioned in the center of the roller 33. An elastic accessory 34 and a ratchet wheel 35 are disposed between the roller 33 and a friction disc 362 of the reel 36. The friction disc 362 is set inside the notch 352 of the ratchet wheel 35, so as to rub against the ratchet wheel 35. The friction disc 362 also leans against the ratchet wheel 35 compactly through the elastic accessory 34. Additionally, a spring 316 and a block part 315 are set within an aperture 313 of the wheel base 31 in sequence to resist the ratchets 351 of the ratchet wheel 35. A cap 38 is fastened at one side of the space 311 of the wheel base 31, and the reel 36 passes through the cap 38. A bearing portion 381 of the cap 38 is against a bearing 364 of the reel 36 through beads 37 positioned thereon. A fixed board 32 is positioned at another side of the wheel base 31, and is fastened onto the pole 10 by putting the wheel base 31 into an opening 101 of the pole 10. A combination portion 363 of the reel 36 passes through a through hole 102 of the pole 10, and is fixed with a handle 39 such that the handle 39 can rotate the reel 36. Moreover, the rope 30 reeling on the roller 33 extends upwards along the pole 10, skirts a pulley 41 positioned on the top of the pole 10, a pulley 42 positioned on the boom 12 and a pulley 43 positioned on the top of the shaft 20, and reaches out to the lower hub 22 through the inner of the shaft 20.

Figure 4:
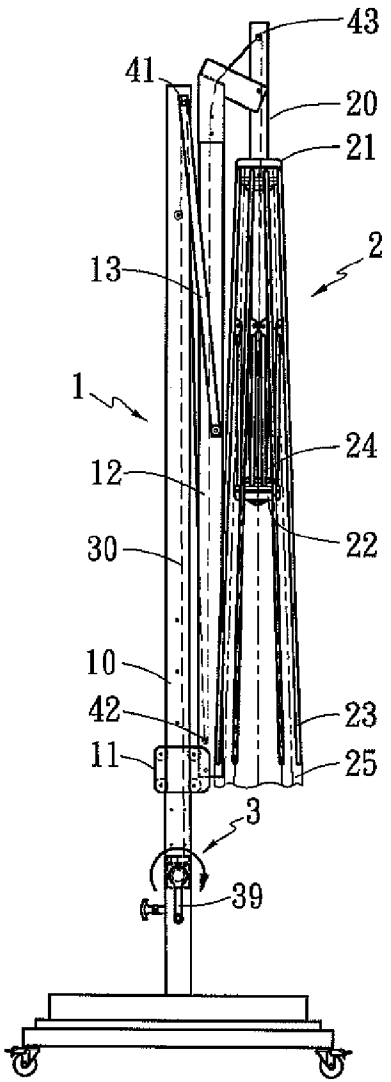
FIG. 4 illustrates the structure of a closed umbrella according to an embodiment of the invention.
Figure 5:
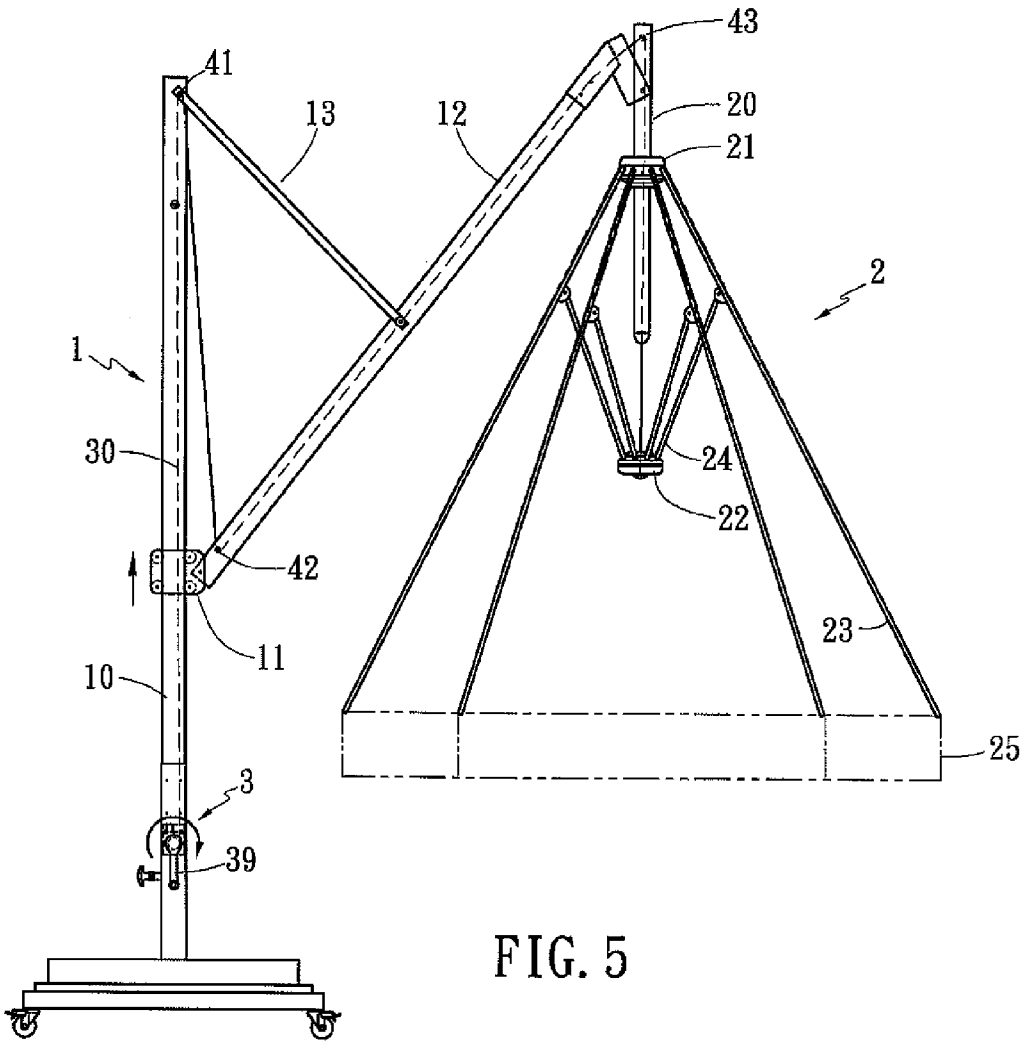
FIG. 5 illustrates the structure of a half-opened umbrella according to an embodiment of the invention.
Figure 6:
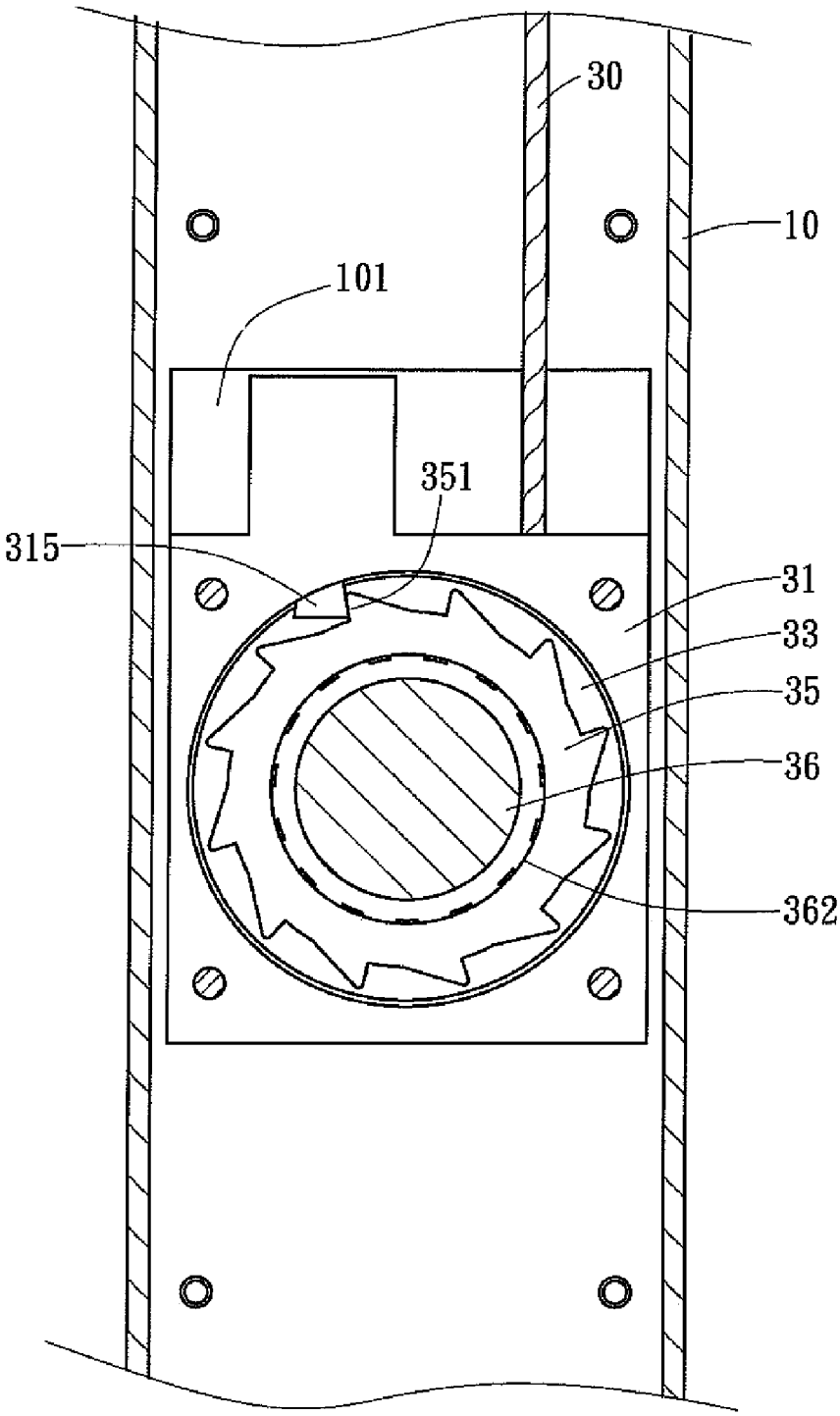
FIG. 6 shows the cross section along the line A-A in FIG. 3.

As shown in FIGS. 3-5, when the handle 39 is rotated clockwise, the ratchet wheel 35 and the roller 33 are moved mutually and the elastic accessory 34 is compressed therebetween because the roller 33 and the reel 36 are screwed together. As a result, the reel 36, the roller 33 and the ratchet wheel 35 are compacted, and the rope 30 is reeled by the roller 33 continuously. While the rope 30 is rolled up, the slide 11 is moved along the pole 10 upwardly, the boom 12 supported by the connecting link 13 is extended, the lower hub 22 is moved upwardly owing to the pull of the rope 30, and the ribs are expanded by the struts 24. Meantime, the ratchets 351 of the ratchet wheel 35 are blocked by the block part 315 so that the roller 33 is not reversed (FIG. 6). When the lower hub 22 stops at the top of the shaft 20, the ribs are expanded completely and the boom 12 raises the umbrella frame 2 up to a predetermined height. The umbrella is thus open.

Figure 7:
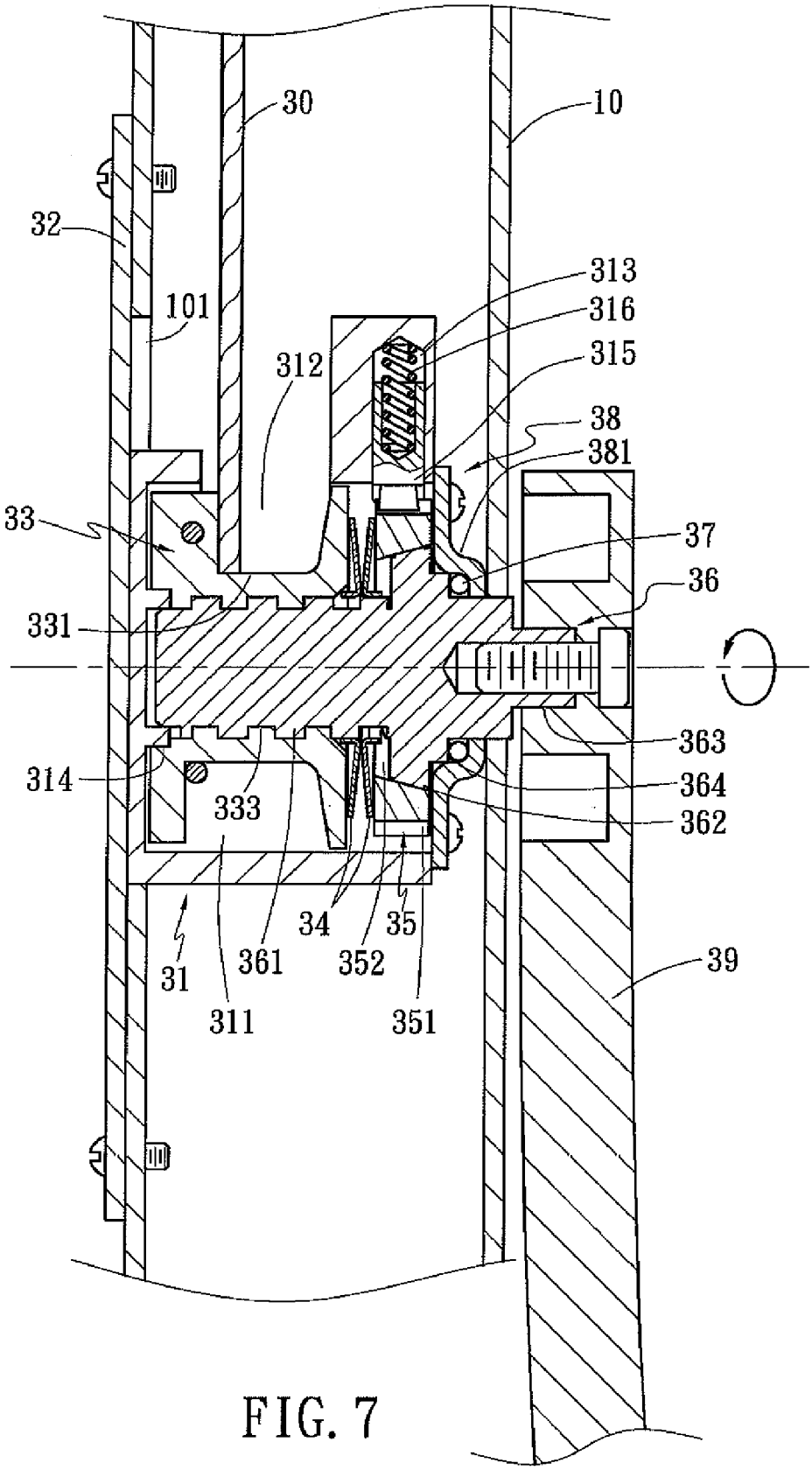
FIG. 7 illustrates the structure of an anti-slip opening and closing device when the umbrella is folded.

Referring to FIG. 7, when the handle 39 is counterclockwise rotated, the reel 36 is backed from the roller 33, and the bearing 364 thereof is obstructed by the beads 37 inside the cap 38. The elastic accessory 34 between the roller 33 and the ratchet wheel 35 keeps pushing the ratchet wheel 33 with a determined force, in order to induce friction between the ratchet wheel 35 and the friction disc 362 of the reel 36 and to prevent the roller 33 from rotating. If the handle 39 remains rotating, the friction becomes minor and the rope 30 will be released due to the continuous rotation of the roller 33. Consequently, the umbrella is folded gradually. If the handle 39 stops rotating, the roller 33 also stops rotating because of the friction produced between the ratchet wheel 35 and the friction disc 362.

Therefore, the umbrella is opened or closed merely by rotating the handle clockwise or counterclockwise. It is not essential to operate the clutch as described in prior arts for preventing the umbrella from collapsing suddenly.

Figure 8:
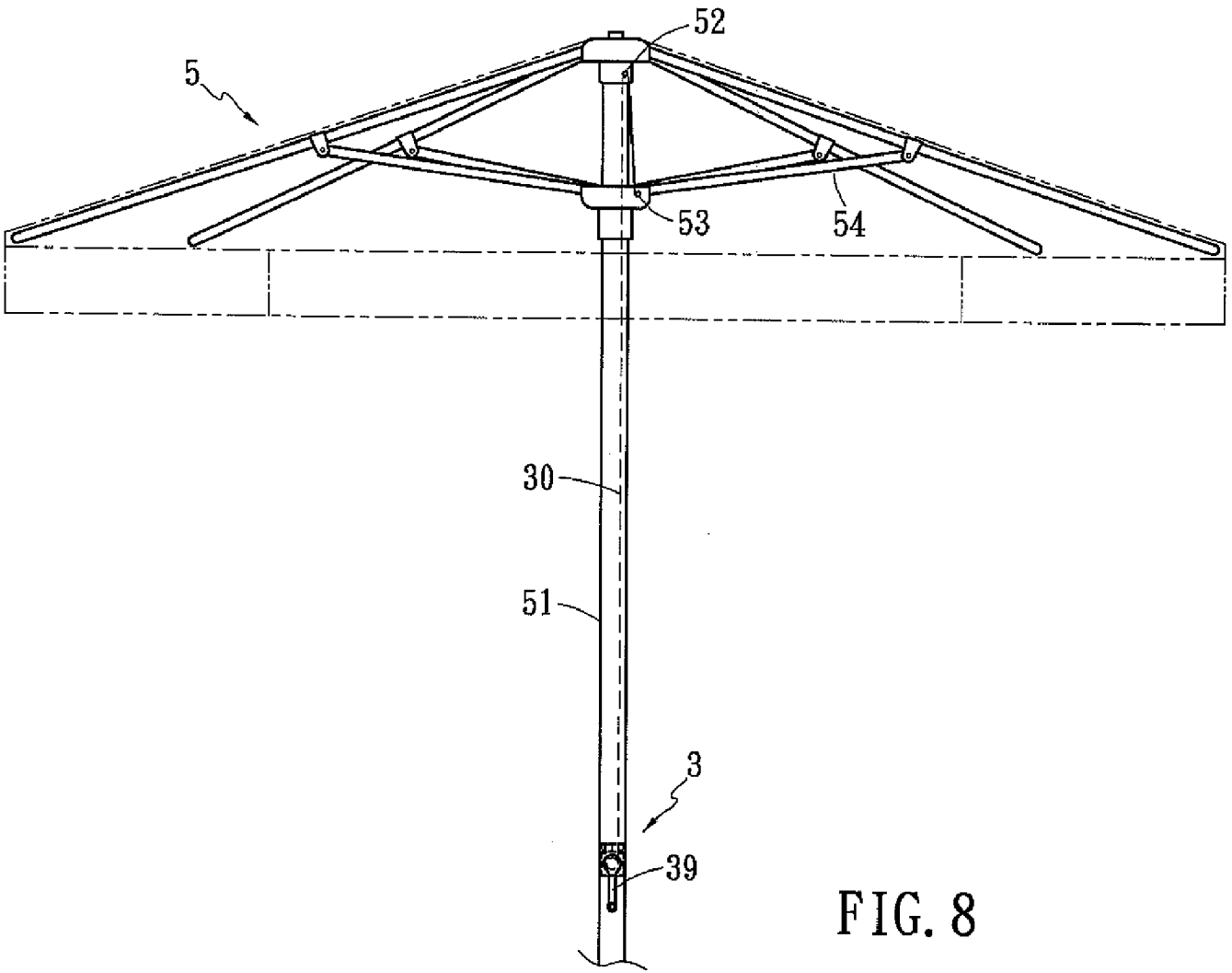
FIG. 8 illustrates the structure of an anti-slip opening and closing device according to another embodiment of the invention.

The aforesaid anti-slip opening and closing device 3 may be assembled onto a sunshade umbrella 5 as illustrated in FIG. 8. The anti-slip opening and closing device 3 is positioned on a pole 51; a rope 30 thereon extends upwardly along the pole 51, skirts and passes through an upper pulley 52, and its end is fixed on a lower hub 53. The rope 30 is rolled or released by clockwise or counterclockwise rotating the handle 39 of the anti-slip opening and closing device 3, making the lower hub 53 move up or down. Accordingly, the ribs 54 are expanded or folded. Such device provides a simpler operating manner and avoids the umbrella collapsing suddenly.

While the invention has been particularly shown and described with reference to the preferred embodiments thereof, these are, of course, merely examples to help clarify the invention and are not intended to limit the invention. It will be understood by those skilled in the art that various changes, modifications, and alterations in form and details may be made therein without departing from the spirit and scope of the invention, as set forth in the following claims.

What is claimed is:

1. An anti-slip opening and closing device for an umbrella, comprising a pole having a rope therein, with one end of the rope connected to a lower hub of the umbrella; at least a strut connected to the lower hub and to a rib of an upper hub of the umbrella, and another end of the rope is reeled on a roller disposed on the pole; wherein the anti-slip opening and closing device comprises a roller connected within a wheel base; a reel screwing with the roller; a friction disc positioned on the reel and set inside a notch of a ratchet wheel; an elastic accessory positioned between the roller and the friction disc for pushing the friction disc to lean against the ratchet wheel; a block part positioned on the wheel base to resist the ratchet wheel reversion; and a bearing positioned at a side of the reel and leaning against beads positioned on a cap at another side of the wheel base.

* * * * *